US007017876B1

(12) United States Patent
LeCher

(10) Patent No.: US 7,017,876 B1
(45) Date of Patent: Mar. 28, 2006

(54) STABILIZING ADJUSTABLE BRACKETS FOR DESIGNING AND CONSTRUCTING A SWING SET/PLAY SET SYSTEM

(76) Inventor: Noel LeCher, 28 Mountain Trail Ct., Cartersville, GA (US) 30120

( * ) Notice: Subject to any disclaimer, the term of this patent is extended or adjusted under 35 U.S.C. 154(b) by 0 days.

(21) Appl. No.: 10/972,967

(22) Filed: Oct. 26, 2004

Related U.S. Application Data

(60) Provisional application No. 60/529,278, filed on Dec. 15, 2003.

(51) Int. Cl.
*A47F 5/00* (2006.01)

(52) U.S. Cl. ..... 248/300; 248/166; 248/165; 182/153; 182/155; 182/181.1; 182/151; 472/118

(58) Field of Classification Search ..... 248/300, 248/166, 165, 370, 168; 182/153, 155, 181.1, 182/186.3, 225, 151, 224, 182.4, 186.5, 186.2, 182/186.1; 472/118
See application file for complete search history.

(56) References Cited

U.S. PATENT DOCUMENTS 249,508 A * 11/1881 Douns ..... 182/185
1,435,738 A * 11/1922 Abraham ..... 182/155
1,881,755 A * 10/1932 Logan et al. ..... 182/153
2,174,952 A * 10/1939 Spikings, Jr. ..... 182/155
2,290,896 A * 7/1942 Spikings, Jr. ..... 182/155
2,573,740 A * 11/1951 Spikings, Jr. ..... 182/155
3,078,956 A * 2/1963 Larson ..... 182/225
3,269,487 A * 8/1966 Larson ..... 182/155
3,978,943 A * 9/1976 Greenman et al. ..... 182/155
4,226,301 A * 10/1980 McDaniel et al. ..... 182/155
4,325,463 A * 4/1982 Taylor ..... 182/155
4,461,370 A * 7/1984 Connell ..... 182/153
4,966,309 A 10/1990 Baer
5,215,162 A * 6/1993 Parks et al. ..... 182/153
5,364,312 A 11/1994 Cunard et al.
6,527,232 B1 3/2003 Robertson et al.
6,564,903 B1 * 5/2003 Krajec ..... 182/153

* cited by examiner

*Primary Examiner*—Kimberly Wood
(74) *Attorney, Agent, or Firm*—William B. Noll

(57) ABSTRACT

A three-piece stabilizing and adjustable bracket member for constructing an A-frame style swing set/play set system, ideal for erection by a do-it-yourself builder. The system includes a first cross beam securing member that features a face plate for selectively mounting a pair of angularly disposed leg support members. The face plate is provided with a single pivotal fastener and plural openings spaced an equal distance from the single pivotal fastener, such that the leg support members may be selectively pivoted about the fastener then secured in one or a pair of the plural openings.

7 Claims, 3 Drawing Sheets

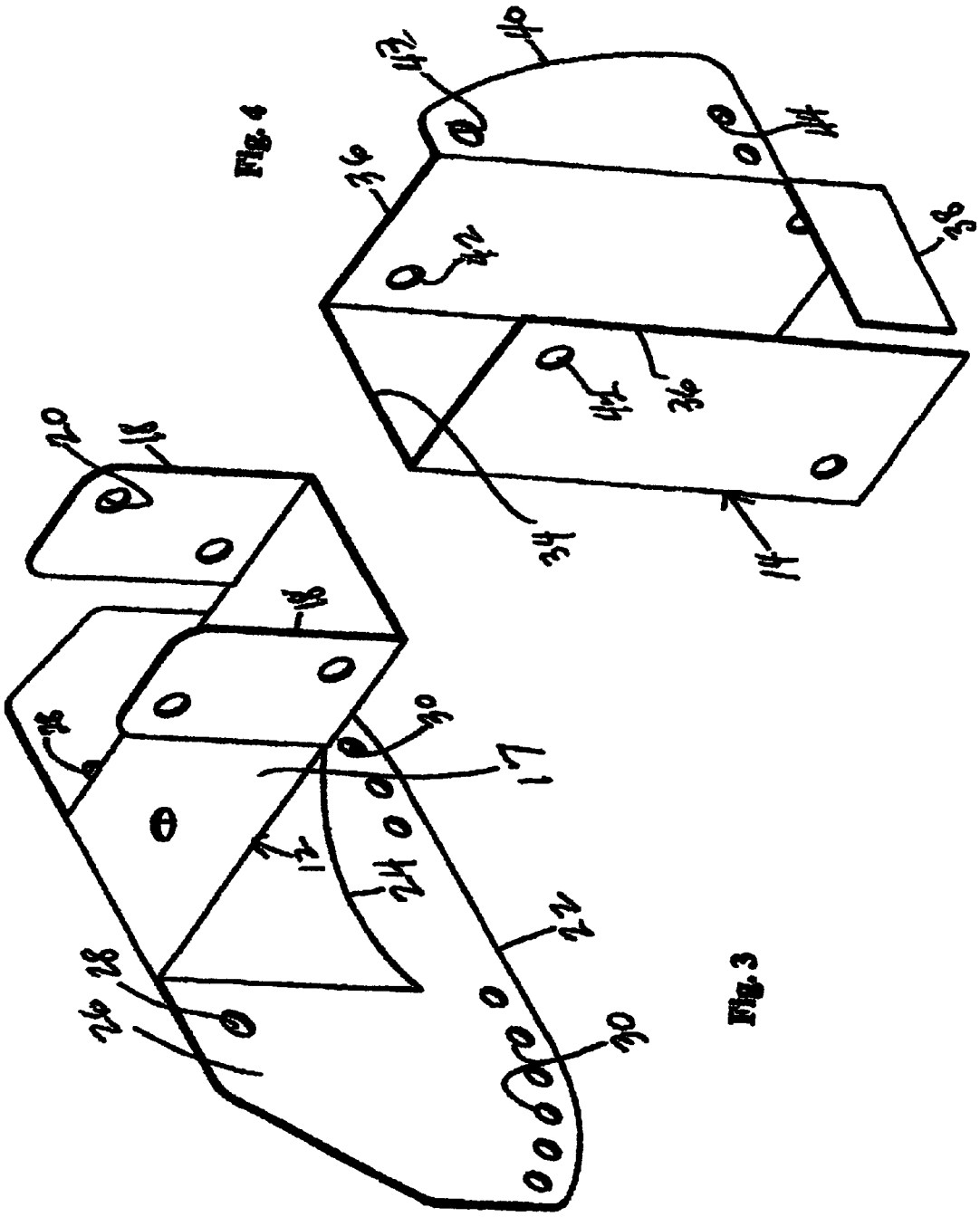
11
12
13
14
15
16
17
18
19
20
21
22
23
24
25
26
27
28
29
30
31
32
33
34
35
36
37
38
39
40
41
42
43
44
45
46
47
48
49
50
51

STABILIZING ADJUSTABLE BRACKETS FOR DESIGNING AND CONSTRUCTING A SWING SET/PLAY SET SYSTEM

RELATED APPLICATION

This application is related to and claims priority of Provisional Application, Ser. No. 60/529,278 filing date is Dec. 15, 2003, by the inventor hereof, with the same title, where the contents thereof are incorporated herein in its entirety.

FIELD OF THE INVENTION

This invention is directed to the field of back yard play gyms and swing sets, more particularly to an adjustable, stabilizing bracket useful to the builder of such play gyms and swing sets, of a general A-frame style, in designing a personalized system for the individuals to be using same, and to constructing such a personalized system.

BACKGROUND OF THE INVENTION

The present invention relates to an adjustable stabilizing bracket for use in designing and constructing an outdoor A-frame style type play gym, swing set, or play set, of the type often found in the back yard of homes, especially those with small children. The bracket is designed and constructed to allow the home owner to personalize the A-frame design, which may be further modified to include such features as swings, teeter totter boards, elevated platforms, slides, etc., where the selected features will depend on the ages of the children to be using same. One disadvantage with a fixed bracket may be found when the erection site is not level, i.e. uneven terrain. An adjustable bracket, such as proposed by this invention, allows the owner to compensate for uneven ground for the personalized A-frame system.

Most of the back yard sets that are found in residential neighborhoods are commercial systems available in many retail outlets and typically consist of an A-frame formed of tubular products, with swings and a teeter totter board suspended from a cross member of a tubular configuration. Further, such commercial systems are held in place with either complicated braces or just simply nails. These fastening mechanisms can lead to instability that may result in injuries or potential dangerous conditions. In any case, personalized systems are not commercially available, and should one design an individualized system, little help can be found from the commercial outlets in finding the fastening members and supports that are needed.

What may be available in the prior art are limited in the freedom to design a personalized system. Several patents from the prior art are found in the following U.S. Patents:

a.) U.S. Pat. No. 6,527,232, to Robertson et al., discloses an A-frame bracket having a rectangular top, and two rectangular side walls that each extend at an angle downwardly from the rectangular top, wherein each side wall has an integrally formed flange forming an "L"-shaped wall for receiving wooden legs that form an A-frame. A disadvantage of this bracket is that it is fixed and not amenable to positioning the A-frame on a grade or uneven terrain.

b.) U.S. Pat. No. 5,364,312, to Cunard et al., relates to a kit for assembling wood legs to form an A-frame to support the end of a cross beam for a children's play gym that includes a trapezoidal frame bracket to connect the upper ends of the legs to each other and to the cross beam and a special frame brace for reinforcing that connection which will accommodate a tubular metal cross beam or a cross beam consisting of a single board or a plurality of boards. The frame brace has a generally rectangular top wall and a pair of laterally spaced apart side walls extending down from the top wall at an angle such that the side walls have more or less the same slope as the side edges of the frame bracket. Portions of the frame brace top wall define a first set of holes spaced apart along the longitudinal centerline of the top wall, there being two such holes in the first set and a second set of holes containing at least two holes spaced along the top wall on each side of that centerline. There also may be a third set of holes containing at least two holes spaced along the top wall on each side of the centerline and being displaced from the second set of holes. The kit also includes fasteners arranged to extend through the first set of holes into the cross beam when the cross beam is a unitary member and through the second and third sets of holes into the cross beam when the cross beam is of wood so that the same hardware can be used to construct play gyms having a variety of different type cross beams.

c.) U.S. Pat. No. 4,966,309, to Baer, teaches a kit for assembling timbers into a play structure. The kit includes a frame bracket which has a frame segment joined at a right angle to a beam segment. The frame segment has four nail or screw holes and the beam segment has two nail or screw holes. The beam segment has a square bolt hole for receiving a carriage bolt. The frame segment is adapted to joining two timbers into an A-frame so formed to a transverse overhead laminated beam. The kit also has a frame brace with a body plate having a flange joined to it at such an angle that when the body is placed flat on the A-frame, the flange lies flat on the beam. The frame brace has nail or screw holes and bolt holes in both the body and the flange. The kit also contains rectangular flat beam clamps adapted to attachment across the laminations of the beam so as to restrict the separating of the laminations. The beam clamps have at least two nail holes and a central bolt hole. The bolt hole being circular on the beam clamp for use with the frame bracket and oblong for use with a swing hanger.

SUMMARY OF THE INVENTION

This invention is directed to an adjustable stabilizing bracket to be used by a do-it-yourself handyman to design and construct a swing set/play set system that allows the handyman to personalize a system, especially on uneven ground, that best suits the needs and challenges of different age group children. The invention teaches an adjustable bracket to give versatility in the design and construction thereof. Specifically, the bracket comprises a first channel element for receiving and securing a cross beam, typically a conventional 4×4 wooden beam, where the channel element terminates in a planar face plate featuring a pair of first anchor openings and a pair of arcuate arrays of second anchor openings. For selective anchoring to said face plate, by means of complementary first and second openings, a pair of leg brackets, typically sized to receive a conventional 4×4 wooden beam, may be secured to the openings. That is, each leg bracket is first secured to a complementary first anchor opening, then pivoted to align openings in the leg bracket to one or selected second anchor openings. By this arrangement the owner, or construction contractor, can angle the received legs to accommodate any uneven ground encountered at the construction site.

Accordingly, a feature of the invention lies in the use of a fixed member for securing a horizontal cross timber, and an adjustable end member for receiving a pair of timber posts for variable angling to one another.

Another feature hereof lies in the use of an adjustable bracket for an A-frame swing set/play set system, where an adjustment may be separately made to individual timber supports.

Still a further feature of the invention is an adjustable bracket from which each of a pair of timber leg support is pivotal about its own pivot point.

These and other features of the invention will become more apparent in the description which follows, especially when read in conjunction with the accompanying drawings.

BRIEF DESCRIPTION OF DRAWINGS

FIG. 3 is a reverse perspective view of the cross beam support element, showing a perpendicular face plate for adjustably mounting a pair of leg support bracket elements.

FIG. 4 is a reverse perspective view of a single leg support bracket element for selective mounting to the face plate of FIG. 3.

DETAILED DESCRIPTION OF PREFERRED EMBODIMENTS

Figure 1:
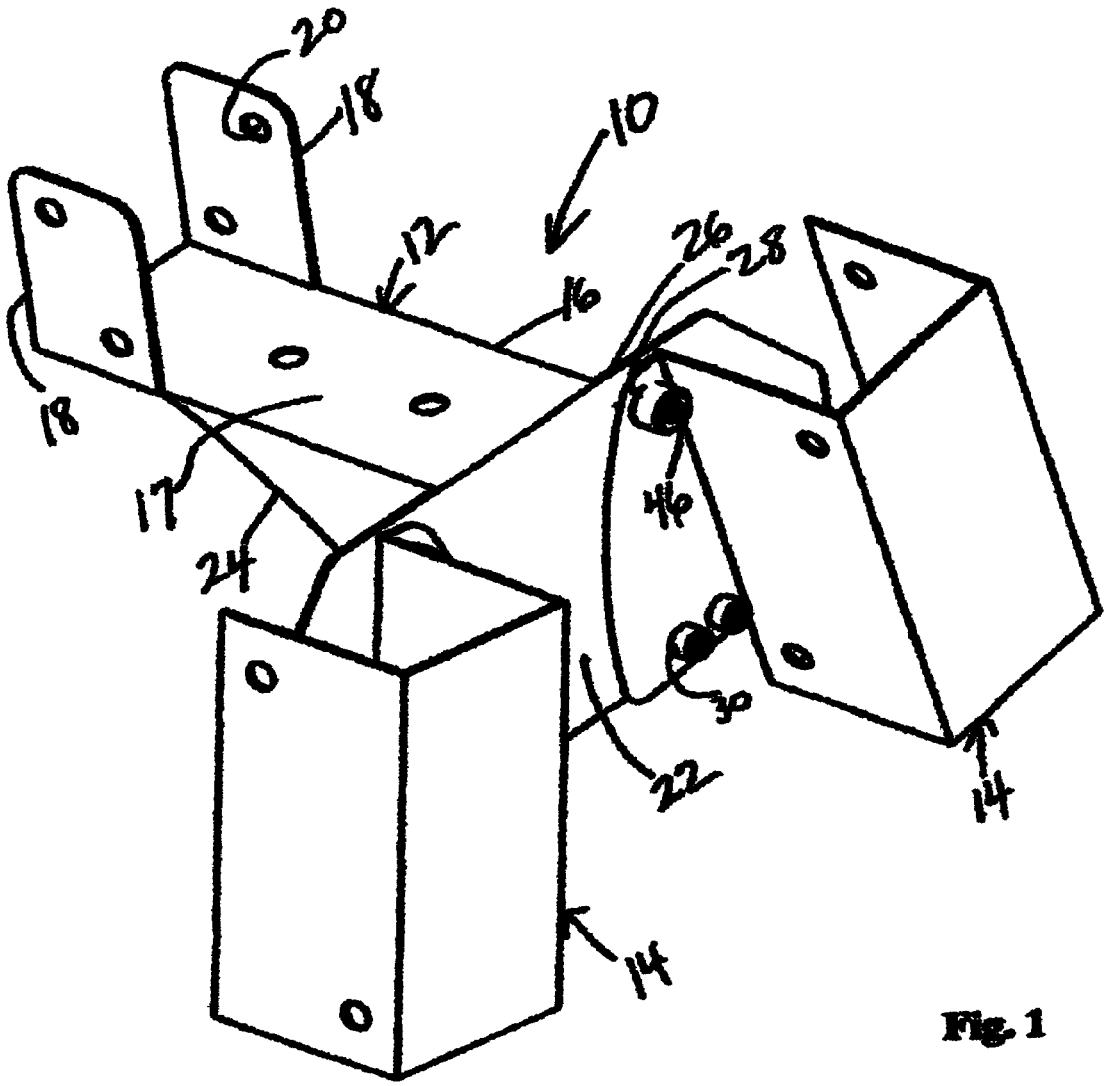
FIG. 1 is a perspective view of the stabilizing, adjustable bracket member for designing and constructing a personalized swing set/play set according to the present invention.

This invention discloses a three part, adjustable bracket member for use in constructing a personalized swing set, gym set, and the like for particular use by do-it-yourself handymen in building a back yard swing set assembly. The stabilizing and adjustable bracket member of this invention is designed to allow the owner, or construction contractor, to construct the swing set, or the like, on uneven ground. That is, one of the biggest obstacles to installing a swing set is the lack of level ground. The ground almost always slopes to one side or the other, which means the installer must either dig a deeper hole in the ground on the sloping side, or cut the support leg. Either solution may be a problem.

The bracket member, fabricated of three separate elements, are individually fabricated from metal blanks, such as galvanized steel, to give strength and stability to the system constructed therefrom. The invention will now be described with regard to the several Figures, where like reference numerals represent like elements or features throughout the various views.

Turning now to FIGS. 1 through 4, FIGS. 1 and 2 illustrate the adjustable bracket member 10 of the invention, where the bracket member comprises a cross beam receiving element 12 and a pair of selectively mounted leg supports 14, where the leg supports may be differently angled as the ground site may dictate.

The cross beam receiving element 12, as shown in a perspective view in FIG. 3, comprises a cross beam support arm 16, having a base 17 and a pair of upturned side supports 18 with openings 20 to fasten, such as with bolts, the cross beam support arm to a wooden cross beam, as known in the art. The space between the side supports 18 is sized to slidably engage a conventional 4×4 wooden timber used for a variety of building projects. At the opposite end of the base 17 is a perpendicularly mounted face plate 22, supported to the base 17 by a pair of angle webs 24. The face plate 22 is characterized by an outer face 26 that features a pair of first upper openings 28 and complementary arcuate arrays of second openings 30, where the distance between the first upper opening 28 and each opening 30 of the arcuate array is equal. In other words, with the upper opening as a center reference or pivot point, the radius to the array of openings is the same, or a predetermined distance. The purpose and use of such openings will become apparent in the further description which follows.

FIG. 4 illustrates an exemplary leg support element 14 for incorporation into this invention, preferably stamped and formed from a sheet metal blank. The leg support element 14 is a generally U-shaped channel having a base 34, a pair of side walls 36, an inturned support arm 38 and an outwardly directed flange 40. The channel, formed by the base and side walls, is of a size to slidably engage a conventional 4×4 wooden timber, where the length of the timber is such as to spacially support the system as designed and constructed. The side walls 36 include plural openings or apertures 42 for nailing or bolting the leg support element 14 to the timber.

Figure 2:
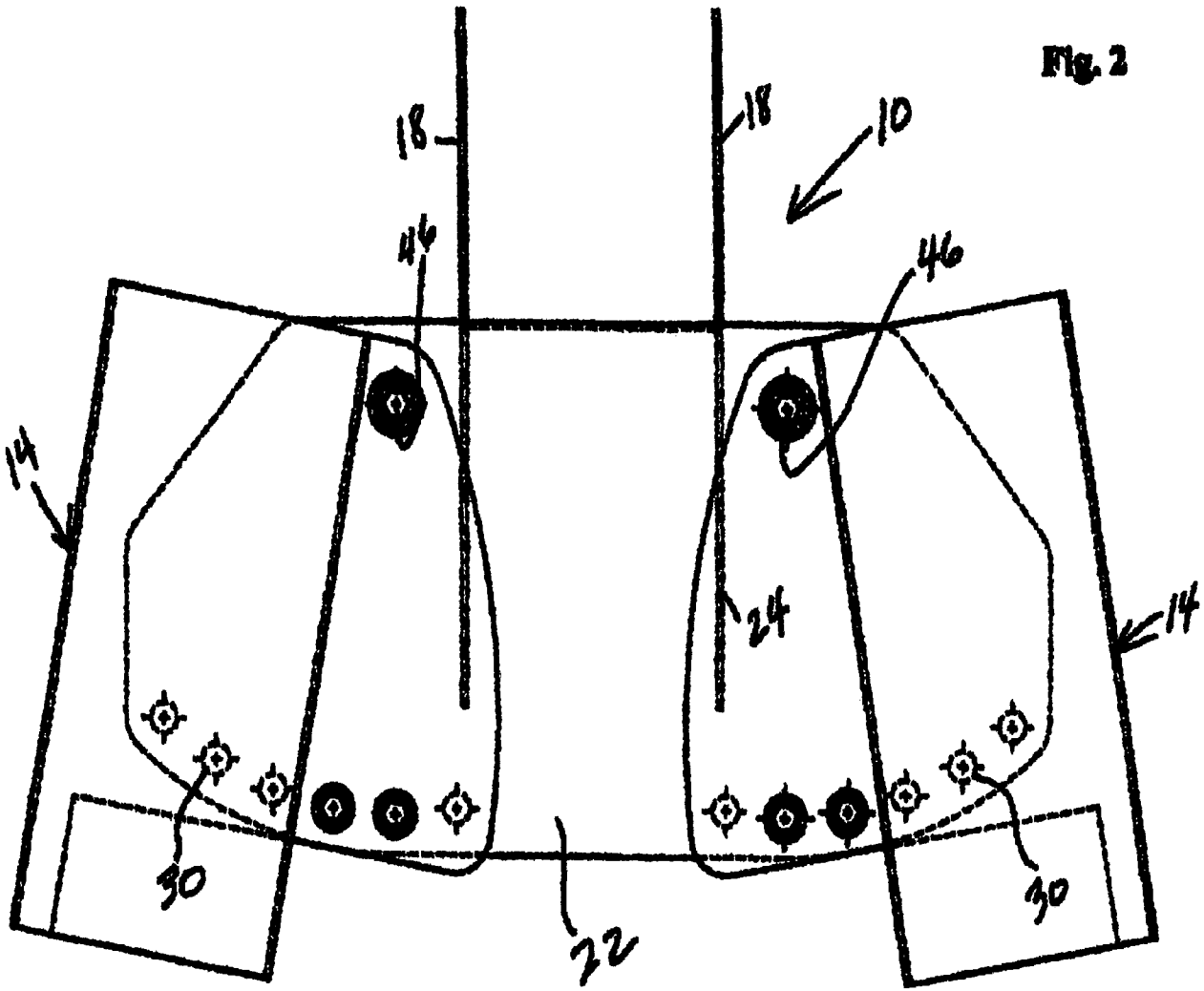
FIG. 2 is a right end view of the stabilizing, adjustable bracket member of FIG. 1.

The outwardly directed flange 40 includes a top opening 43 and a pair of second openings 44, where the distance between the top opening 42 and the second openings 44 are equal to said predetermined distance, as discussed above with regard to the spacing between opening 28 and the arcuate openings 30. Thus, with the first upper opening 28 aligned, such as by a fastening member 46, the second openings 44 will be aligned with selected second openings 30 depending on the angle desired. Though FIGS. 1 and 2 show the leg supports angled equally, the bracket member 10 can be adjusted as desired with the respective leg support elements 14 angled differently. That is, on an angled slope, one leg support may be angled differently from its companion leg support to ensure a properly positioned swing set/play set.

It is recognized that changes, variations and modifications may be made to the stabilizing adjustable bracket of this invention without departing from the spirit and scope thereof. Accordingly, no limitation is intended to be imposed thereon except as set forth in the appended claims.

I claim:

1. A three-piece stabilizing and adjustable bracket member for constructing an A-frame style swing set and the like, where the bracket member, fabricated from flat metal sheet blanks, is intended to receive and mount plural wooded beams, said bracket member comprising:

a.) a cross beam element comprising a cross beam support member having a pair of upturned flange members at one end thereof for securing said cross beam element to a wooden beam, and an opposite end mounting a perpendicularly oriented face plate, where the face plate is reinforced by a pair of angle webs to said cross beam support member, said face plate featuring a pair of top openings and a pair of arrays of lower openings, with the lower openings being an equal distance to said upper opening; and, b.) a pair of leg support elements for selective angular mounting to said face plate, each said leg support element comprising a U-shaped channel and an outwardly extending flange, said flange having an upper opening and plural lower openings, where said flange upper and lower openings are sized to be aligned with said face plate upper and lower openings, respectively, whereby said leg supports may be selectively angled to said cross beam support member.

2. The three-piece stabilizing and adjustable bracket member according to claim 1, wherein each said top opening defines a pivot point for selectively adjusting said support elements, and each said array of lower openings are aligned along a circumference with said top opening as the center.

3. The three-piece stabilizing and adjustable bracket member according to claim 2, wherein adjacent openings of said array of openings are a predetermined arcade distance, and said lower openings are spaced an arcade equal to said predetermined arcade distance.

4. The three-piece stabilizing and adjustable bracket member according to claim 1, wherein said bracket is fabricated from galvanized steel sheet.

5. The three-piece stabilizing and adjustable bracket member according to claim 4, wherein each said leg support element is stamped and formed from a sheet steel blank.

6. The three-piece stabilizing and adjustable bracket member according to claim 1, wherein said upturned flange members include plural fastener receiving apertures to secure same to said wooden beam.

7. The three-piece stabilizing and adjustable bracket member according to claim 1, wherein said leg support element comprises a U-shaped channel having a base and two spaced apart members extending perpendicular to said base, and said spaced apart members including plural fastener receiving apertures for securing same to a said wooden beam.

* * * * *